US005832750A

United States Patent [19]

Yamamoto

[11] Patent Number: 5,832,750

[45] Date of Patent: Nov. 10, 1998

[54] COMBINATION WASHER-DRIER SYSTEM

[76] Inventor: Keiko Yamamoto, One Kelton Ct. 1B, Oakland, Calif. 94611

[21] Appl. No.: 677,646

[22] Filed: Jul. 8, 1996

[51] Int. Cl.[6] ..... D06F 39/04

[52] U.S. Cl. ..... 68/13 R; 68/19.2; 68/235 D

[58] Field of Search ..... 68/24, 58, 140, 68/142, 19.2, 20, 235 D, 13 R; 134/159

[56] References Cited

U.S. PATENT DOCUMENTS

| | | | |
|---|---|---|---|
| 1,591,314 | 7/1926 | Huddle | 134/159 |
| 2,574,798 | 11/1951 | Rasmussen | 168/19.2 |
| 2,827,783 | 3/1958 | Handley | 68/19.2 |
| 2,882,708 | 4/1959 | Hancock et al. | 68/235 D |
| 2,909,053 | 10/1959 | Coatsworth | 68/235 D |
| 3,018,488 | 1/1962 | Snead | 68/235 D |
| 3,239,845 | 3/1966 | Polzin | 68/235 D |
| 3,277,675 | 10/1966 | Scott | 68/181 D |
| 3,308,640 | 3/1967 | Russey | 68/235 D |
| 3,568,476 | 3/1971 | Seyler | 68/19.2 |
| 4,498,317 | 2/1985 | Thysen et al. | 68/19.2 |

*Primary Examiner*—Frankie L. Stinson

[57] ABSTRACT

A new Combination Washer-Drier System for providing a combination washer and drier that can be mounted in various areas of a building, thereby allowing utilization of an existing fixture such as a toilet or a washbasin for supplying water to the present invention and for draining wash water from the present invention. The inventive device includes a power source, a compact combination washer-drier means connected to the power source, a water supplying means connected to the combination washer-drier means, a controller means electronically connected to the combination washer-drier means, an existing fixture such as a toilet or a washbasin connected to the combination washer-drier means, a mounting means securing the combination washer-drier means to a wall, and a draining means engaging the combination washer-drier means draining waste water from the present invention.

7 Claims, 3 Drawing Sheets

COMBINATION WASHER-DRIER SYSTEM

BACKGROUND OF THE INVENTION

1. Field of the Invention

The present invention relates to Washer-Dryer Devices and more particularly pertains to a new Combination Washer-Drier System for providing a combination washer and drier that can be mounted in various areas of a building, thereby allowing utilization of an existing fixture such as a toilet or a washbasin for supplying water to the present invention and for draining wash water from the present invention.

2. Description of the Prior Art

The use of Washer-Dryer Devices is known in the prior art. More specifically, Washer-Dryer Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Washer-Dryer Devices include U.S. Pat. No. 4,765,162; U.S. Pat. No. 4,154,003; Design U.S. Pat. No. 301,780; U.S. Pat. No. 4,336,619; U.S. Pat. No. 4,534,188, Design U.S. Pat. No. 271,815 and Design U.S. Pat. No. 298,873.

While these devices fulfill their respective, particular objectives and requirements, the aforementioned patents do not disclose a new Combination Washer-Drier System. The inventive device includes a power source, a compact combination washer-drier means connected to the power source, a water supplying means connected to the combination washer-drier means, a controller means electronically connected to the combination washer-drier means, an existing fixture such as a toilet or a washbasin connected to the combination washer-drier means, a mounting means securing the combination washer-drier means to a wall, and a draining means engaging the combination washer-drier means draining waste water from the present invention.

In these respects, the Combination Washer-Drier System according to the present invention substantially departs from the conventional concepts and designs of the prior art, and in so doing provides an apparatus primarily developed for the purpose of providing a combination washer and drier that can be mounted in various areas of a building, thereby allowing utilization of an existing fixture such as a toilet or a washbasin for supplying water to the present invention and for draining wash water from the present invention.

SUMMARY OF THE INVENTION

In view of the foregoing disadvantages inherent in the known types of Washer-Dryer Devices now present in the prior art, the present invention provides a new Combination Washer-Drier System construction wherein the same can be utilized for providing a combination washer and drier that can be mounted in various areas of a building, thereby allowing utilization of an existing fixture such as a toilet or a washbasin for supplying water to the present invention and for draining wash water from the present invention. The general purpose of the present invention, which will be described subsequently in greater detail, is to provide a new Combination Washer-Drier System apparatus and method which has many of the advantages of the Washer-Dryer Devices mentioned heretofore and many novel features that result in a new Combination Washer-Drier System which is not anticipated, rendered obvious, suggested, or even implied by any of the prior art Washer-Dryer Devices, either alone or in any combination thereof.

To attain this, the present invention generally comprises a power source, a compact combination washer-drier means connected to the power source, a water supplying means connected to the combination washer-drier means, a controller means electronically connected to the combination washer-drier means, an existing fixture such as a toilet or a washbasin connected to the combination washer-drier means, a mounting means securing the combination washer-drier means to a wall, and a draining means engaging the combination washer-drier means draining waste water from the present invention.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Combination Washer-Drier System apparatus and method which has many of the advantages of the Washer-Dryer Devices mentioned heretofore and many novel features that result in a new Combination Washer-Drier System which is not anticipated, rendered obvious, suggested, or even implied by any of the prior art Washer-Dryer Devices, either alone or in any combination thereof.

It is another object of the present invention to provide a new Combination Washer-Drier System which may be easily and efficiently manufactured and marketed.

It is a further object of the present invention to provide a new Combination Washer-Drier System which is of a durable and reliable construction.

An even further object of the present invention is to provide a new Combination Washer-Drier System which is susceptible of a low cost of manufacture with regard to both materials and labor, and which accordingly is then susceptible of low prices of sale to the consuming public, thereby making such Combination Washer-Drier System economically available to the buying public.

Still yet another object of the present invention is to provide a new Combination Washer-Drier System which provides in the apparatuses and methods of the prior art some of the advantages thereof, while simultaneously overcoming some of the disadvantages normally associated therewith.

Still another object of the present invention is to provide a new Combination Washer-Drier System for providing a combination washer and drier that can be mounted in various areas of a building, thereby allowing utilization of an existing fixture such as a toilet or a washbasin for supplying water to the present invention and for draining wash water from the present invention.

Yet another object of the present invention is to provide a new Combination Washer-Drier System which includes a power source, a compact combination washer-drier means connected to the power source, a water supplying means connected to the combination washer-drier means, a controller means electronically connected to the combination washer-drier means, an existing fixture such as a toilet or a washbasin connected to the combination washer-drier means, a mounting means securing the combination washer-drier means to a wall, and a draining means engaging the combination washer-drier means draining waste water from the present invention.

Even still another object of the present invention is to provide a new Combination Washer-Drier System wherein the user is able to mount the present invention in various areas in a building.

Still another object of the present invention is to provide a new Combination Washer-Drier System that utilizes an existing fixture such as a toilet or a washbasin to supply the present invention with water.

Another object of the present invention is to provide a new Combination Washer-Drier System that utilizes an existing fixture such as a toilet or a washbasin for draining waste water from the present invention.

Still another object of the present invention is to provide a new Combination Washer-Drier System that utilizes unused space in a building.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
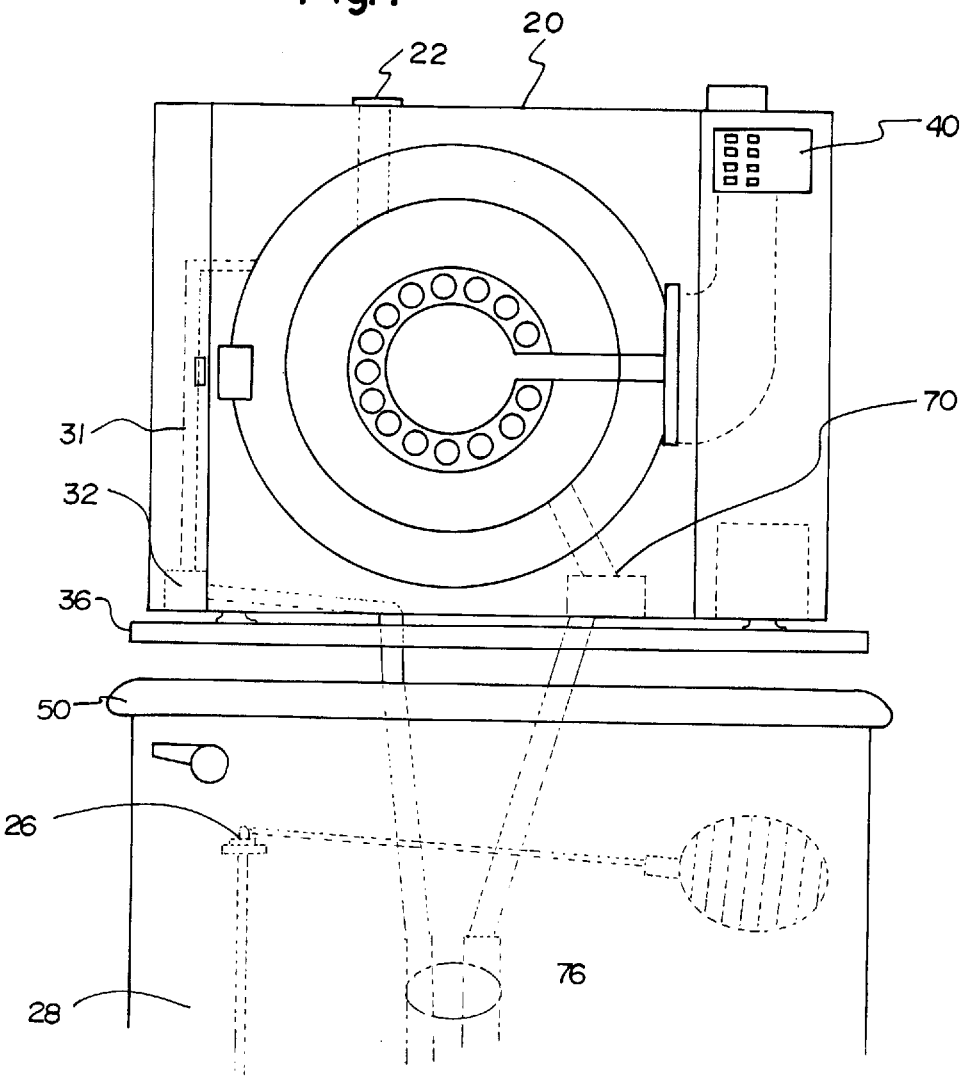
FIG. 1 is a front view of a new Combination Washer-Drier System according to the present invention.
Figure 2:
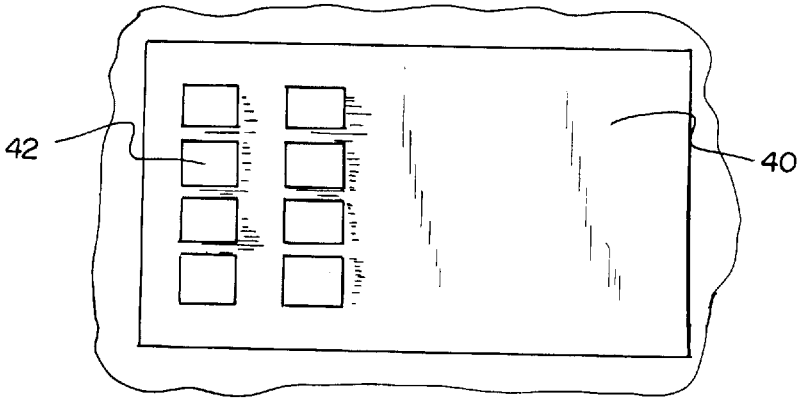
FIG. 2 is an enlarged view of the controller means.

With reference now to the drawings, and in particular to FIGS. 1 through 6 thereof, a new Combination Washer-Drier System embodying the principles and concepts of the present invention and generally designated by the reference numeral 10 will be described.

More specifically, it will be noted that the Combination Washer-Drier System 10 comprises a standard compact combination washer-drier means 20, a power supply 14 electronically connected to the compact combination washer-drier means 20, a water supplying means 30 connected to the compact combination washer-drier means 20, a controller means 40 electronically connected to the compact combination washer-drier means 20, an existing toilet 26 connected to the compact combination washer-drier means 20, a mounting means 60 securing the compact combination washer-drier means 20 to a wall 12 and a draining means 70 connected to the compact combination washer-drier means 20.

Figure 3:
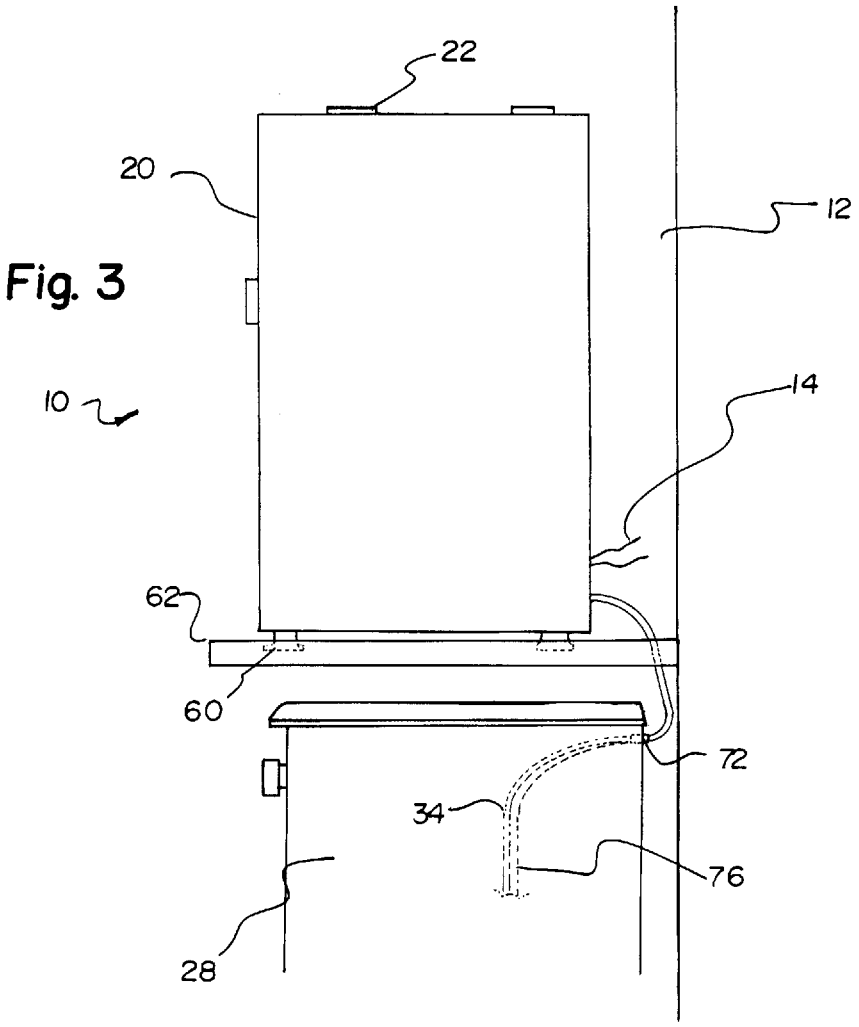
FIG. 3 is an enlarged right side view of the present invention.
Figure 4:
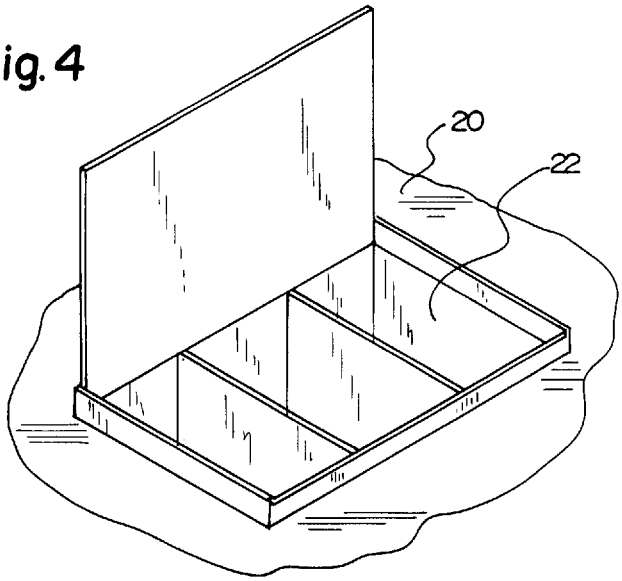
FIG. 4 is an enlarged view taken along line 4—4 of FIG. 3.
Figure 5:
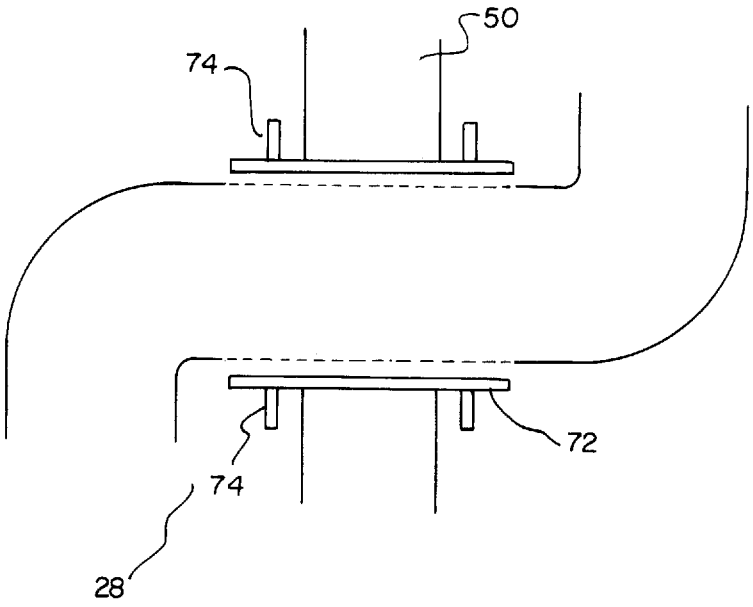
FIG. 5 is an enlarged cross sectional view taken along line 5—5 of FIG. 1 of the draining means.
Figure 6:
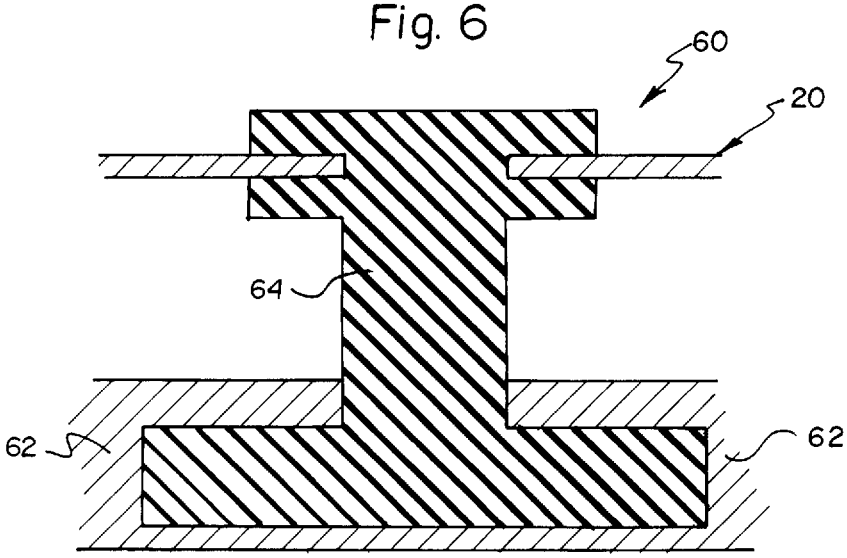
FIG. 6 is an enlarged cross sectional view taken along line 6—6 of FIG. 3 of an I-shaped leg.

As best illustrated in FIGS. 1 through 6, it can be shown that the compact combination washer-drier means 20 includes an exhaust means 24 connected to an unnumbered drier portion of the compact combination washer-drier means 20. A soap storage dish 22 is connected to an unnumbered washer portion of the compact combination washer-drier means 20. The water supplying means 30 includes a first water supply pipe 31 secured to the compact combination washer-drier means 20. A water pump means 32 is connected to the end of the first water supply pipe 31 opposite of the compact combination washer-drier means 20 pumping water from the existing toilet 26 to the compact combination washer-drier means 20. A second water supply pipe 34 is connected to the water pump means 32. The mounting means 60 includes a shelf member 62, at least three I-shaped legs 64 secured to the top surface of the shelf member 62 where the opposite ends of the I-shaped legs are secured to the bottom surface of the compact combination washer-drier means 20. The I-shaped legs 64 are constructed from a resilient material absorbing the vibrations emanating from the present invention during operation as best shown in FIG. 6 of the drawings. The shelf member 62 includes a shelf drain aperture 66 and a shelf supply aperture 36. A shelf securing means 68 secures the shelf member 62 to the wall 12 of the building thereby supporting the present invention as best shown in FIG. 3 of the drawings. The draining means 70 includes a drain pipe member 72 connected to the compact combination washer-drier means 20 projecting through the shelf drain aperture 66 then through a cover drain aperture 52 in a water tank cover 50. One end of a toilet drain coupler 76 is attached to the drain pipe member 72 opposite of the compact combination washer-drier means 20 and the opposite end of the toilet drain coupler 76 engages an unnumbered toilet drain in a water tank 28 of the existing toilet 26. The second water supply pipe 34 projects through the shelf supply aperture 36 then through a cover supply aperture 38 in the water tank cover 50. The second water supply pipe 34 then projects below the unnumbered water level of the water tank 28 as best shown in FIG. 1 of the drawings. The drain pipe member 72 includes at least one pipe supporting ring 74 surrounding the drain pipe member 72 and then engaging the shelf member 62 as shown in FIG. 5 of the drawings. Another pipe supporting ring 74 surrounds the drain pipe member 72 and then engages the water tank cover 50 preventing the drain pipe member 72 from vibrating against the shelf member 62 and the water tank cover 50.

In an alternative embodiment of the present invention, an unnumbered fixture such as a washbasin would replace the existing toilet 26. The second water supply pipe 34 would attach to an unnumbered faucet and the drain pipe member 72 would project into the unnumbered fixture's drain.

In use, the user facilitates operation the washer portion of the compact combination washer-drier means 20 with the controller means 40. During operation, the water pump means 32 creates a vacuum in the second water supply pipe 34 which projects below the unnumbered water level in the water tank 28. Water from the water tank 28 is then pumped through the second water supply pipe 34 projecting through the first water supply pipe 31 into the compact combination washer-drier means 20. After washing of the clothes, the unnumbered washing water is drained out through the drain pipe member 72 into the unnumbered toilet drain. Then using the controller means 40, the user would then facilitate operation of the unnumbered drier portion where the exhaust means 24 would remove the warm humid air from the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination washer-dryer system comprising:

a standard compact combination washer-dryer means;

a power supply electronically connected to the compact combination washer-dryer means for providing water to the washer-dryer means;

a water supplying means connected to the compact combination washer-dryer means;

a controller means electronically connected to the compact combination washer-dryer means;

a mounting means securing the compact combination washer-dryer means to a building structure;

a draining means connected to the compact combination washer-dryer means, and said draining means being adapted for coupling to a drain of a toilet such that water drained from the washer-dryer means is drainable through the drain of the toilet; and said water supplying means being adapted for coupling to a water tank of the toilet such that water from the tank of the toilet is providable to said washer-dryer means.

2. The combination washer-dryer system of claim 1, wherein the compact combination washer-dryer means includes an exhaust means connected to the dryer portion of the compact combination washer-dryer means; and a soap storage dish connected to the washer portion of the compact combination washer-dryer means.

3. The combination washer-dryer system of claim 2, wherein the water supplying means includes:

a first water supply pipe secured to the compact combination washer-dryer means;

a water pump means connected to the end of the first water supply pipe opposite of the compact combination washer-dryer means; and a second water supply pipe connected to the water pump means.

4. A combination washer-dryer system comprising:

a compact combination washer-dryer means for washing and drying;

a power supply electronically connected to the compact combination washer-dryer means;

a water supplying means for supplying water to the washer-dryer means, the water supplying means being connected to the compact combination washer-dryer means;

a controller means for operating the washer-dryer means, the controller means being electronically connected to the compact combination washer-dryer means;

an existing toilet connected to the compact combination washer-dryer means;

a mounting means for securing the compact combination washer-dryer means to a building structure; and a draining means for draining the washer-dryer means, the draining means being connected to the compact combination washer-dryer means;

wherein the compact combination washer-dryer means includes an exhaust means for permitting exhaust to be expelled from the washer-dryer means, the exhaust means being connected to the dryer portion of the compact combination washer-dryer means; and a soap storage dish connected to the washer portion of the compact combination washer-dryer means;

wherein the water supplying means includes:

a first water supply pipe secured to the compact combination washer-dryer means;

a water pump means for pumping water, the water pump means being connected to the end of the first water supply pipe opposite of the compact combination washer-dryer means; and a second water supply pipe connected to the water pump means; and wherein the mounting means includes:

a shelf member;

at least three I-shaped legs secured to the top surface of the shelf member where the opposite ends of the I-shaped legs are secured to the bottom surface of the compact combination washer-dryer means where the I-shaped legs are constructed from a resilient material;

the shelf member including a shelf drain aperture and a shelf supply aperture; and a shelf securing means coupling the shelf member to a wall of the building.

5. The combination washer-dryer system of claim 4, wherein the draining means includes a drain pipe member connected to the compact combination washer-dryer means projecting through the shelf drain aperture then through a cover drain aperture in a water tank cover; one end of a toilet drain coupler is attached to the drain pipe member opposite of the compact combination washer-dryer means and the opposite end of the toilet drain coupler engages a toilet drain in a water tank of the existing toilet.

6. The combination washer-dryer system of claim 5, wherein the second water supply pipe projects through the shelf supply aperture then through a cover supply aperture in the water tank cover then projecting below the water level of the water tank of the existing toilet.

7. The combination washer-dryer system of claim 6 wherein the drain pipe member includes at least one pipe supporting ring surrounding the drain pipe member and then engaging the shelf member; and another pipe supporting ring surrounding the drain pipe member and then engaging the water tank cover.

* * * * *